US007021111B2

(12) United States Patent
Chang

(10) Patent No.: US 7,021,111 B2
(45) Date of Patent: Apr. 4, 2006

(54) FORGING MACHINE WITH A GUIDING ROLLER MECHANISM FOR GUIDING MOVEMENT OF A SLIDING PLATE UNIT

(75) Inventor: Yun-Te Chang, Tainan (TW)

(73) Assignee: FWU Kuang Enterprises Co., Ltd., Tainan Hsien (TW)

( * ) Notice: Subject to any disclaimer, the term of this patent is extended or adjusted under 35 U.S.C. 154(b) by 47 days.

(21) Appl. No.: 10/887,064

(22) Filed: Jul. 8, 2004

(65) Prior Publication Data

US 2006/0005597 A1 Jan. 12, 2006

(51) Int. Cl.
*B21D 22/00* (2006.01)

(52) U.S. Cl. ..... 72/361; 72/344; 72/345; 72/356; 72/339; 470/152; 470/153; 470/154

(58) Field of Classification Search ..... 72/361, 72/344, 345, 356, 339; 470/152, 153, 154
See application file for complete search history.

(56) References Cited

U.S. PATENT DOCUMENTS 5,519,932 A * 5/1996 Kuze ..... 29/564.1
5,732,589 A * 3/1998 McClellan et al. ..... 72/405.12
6,269,673 B1 * 8/2001 Wang ..... 72/405.11
6,446,479 B1 * 9/2002 Garlaschi ..... 72/361

* cited by examiner

*Primary Examiner*—Derris H. Banks
*Assistant Examiner*—Teresa M. Bonk
(74) *Attorney, Agent, or Firm*—The Webb Law Firm

(57) ABSTRACT

A forging machine includes a machine bed, a driving unit driven by a driving source to activate a feeding unit, a sliding seat unit, and a forging unit. The machine bed includes left and right sidewalls. The driving unit is disposed at an inner side of the left sidewall. The sliding seat unit is disposed at an outer side of the right sidewalls, and includes a sliding plate unit that can reciprocate forwardly and rearwardly to activate a cutting unit and a holding unit. The sliding plate unit is guided by a guiding roller mechanism such that the sliding plate unit moves smoothly.

3 Claims, 7 Drawing Sheets

FORGING MACHINE WITH A GUIDING ROLLER MECHANISM FOR GUIDING MOVEMENT OF A SLIDING PLATE UNIT

BACKGROUND OF THE INVENTION

1. Field of the Invention

This invention relates to a forging machine, and more particularly to a forging machine that includes a guiding roller mechanism for guiding movement of a sliding plate unit.

2. Description of the Related Art

Referring to FIGS. 1 and 2, a conventional forging machine 1 is shown to include a machine bed 11, a feeding unit 13 disposed at a front end of a right side of the machine bed 11 for feeding a linear material 10 intermittently, a female die mechanism 14 disposed on a front portion of the machine bed 11, a male die mechanism 15 disposed on the machine bed 11 behind the female die mechanism 14, a cutting mechanism 16 movable reciprocally between the female and male die mechanisms 14, 15 for cutting the material 10 to form blanks, a holding mechanism 17 for holding and conveying the blanks, and a sliding plate unit 18 for driving the cutting mechanism 16 and the holding mechanism 17.

The holding mechanism 17 includes a plurality of openable and closable holders 171. The blanks are moved among the holders 171. The male die mechanism 15 cooperates with the female die mechanism 14 to perform successive forging of the blanks.

Power is transmitted to the feeding mechanism 13, the male die mechanism 15, the cutting mechanism 16, and a portion of the holding mechanism 17 by means of members that are disposed at a right side of the forging machine 1, and to the remaining portion of the holding mechanism 17 by means of members that are disposed at a left side of the forging machine 1.

Opening and closing of the holders 171 is controlled by first and second driving shafts 172, 173 that are interconnected by a bevel gear unit. The sliding plate unit 18 is provided with a fixed camming plate 181 for pushing the cutting unit 16 and the holders 171 to reciprocate.

The aforesaid conventional forging machine 1 suffers from the following disadvantages:

(1) The sliding plate unit 18 cannot reciprocate smoothly due to frictional contact with guiding means disposed on the machine bed 11.

(2) The sliding plate unit 18 and an assembly of the first and second driving shafts 172, 173 are disposed respectively on right and left sides of the machine bed 11. As a result, a sufficient working space is not provided to allow a technician to check the condition of the holders 171.

SUMMARY OF THE INVENTION

An object of this invention is to provide a forging machine that includes a guiding roller mechanism, which can guide a sliding plate unit such that the sliding plate unit moves smoothly.

Another object of this invention is to provide a forging machine that has a relatively large space which is located adjacent to a holding unit such that a technician can stand in the space to check the condition of the holding unit.

According to this invention, a forging machine includes a machine bed, a driving unit driven by a driving source to activate a feeding unit, a sliding seat unit, and a forging unit. The machine bed includes left and right sidewalls. The driving unit is disposed at an inner side of the left sidewall. Thus, a technician can stand adjacent to an outer side surface of the left sidewall to check the condition of the holding unit. The sliding seat unit is disposed at an outer side of the right sidewalls, and includes a sliding plate unit that can reciprocate forwardly and rearwardly to activate a cutting unit and a holding unit. The sliding plate unit is guided by a guiding roller mechanism such that the sliding plate unit moves smoothly.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
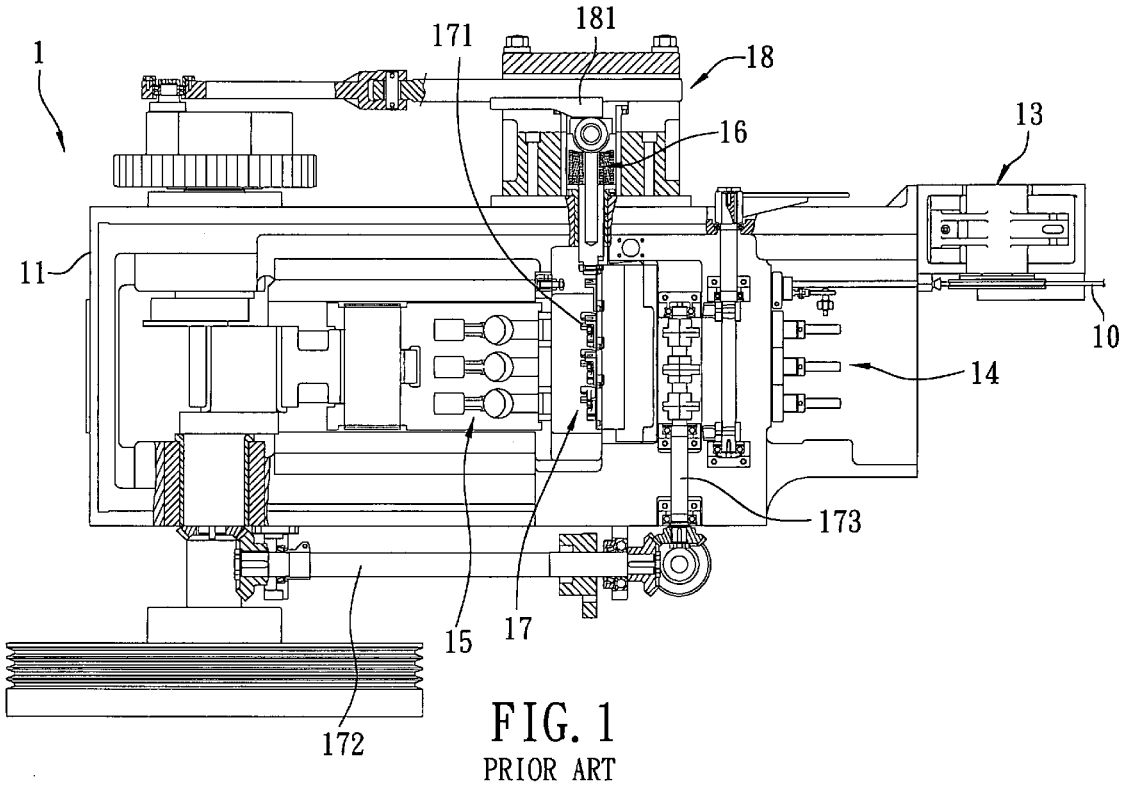
FIG. 1 PRIOR ART
FIG. 1 is a schematic partly sectional top view of a conventional forging machine.
Figure 2:
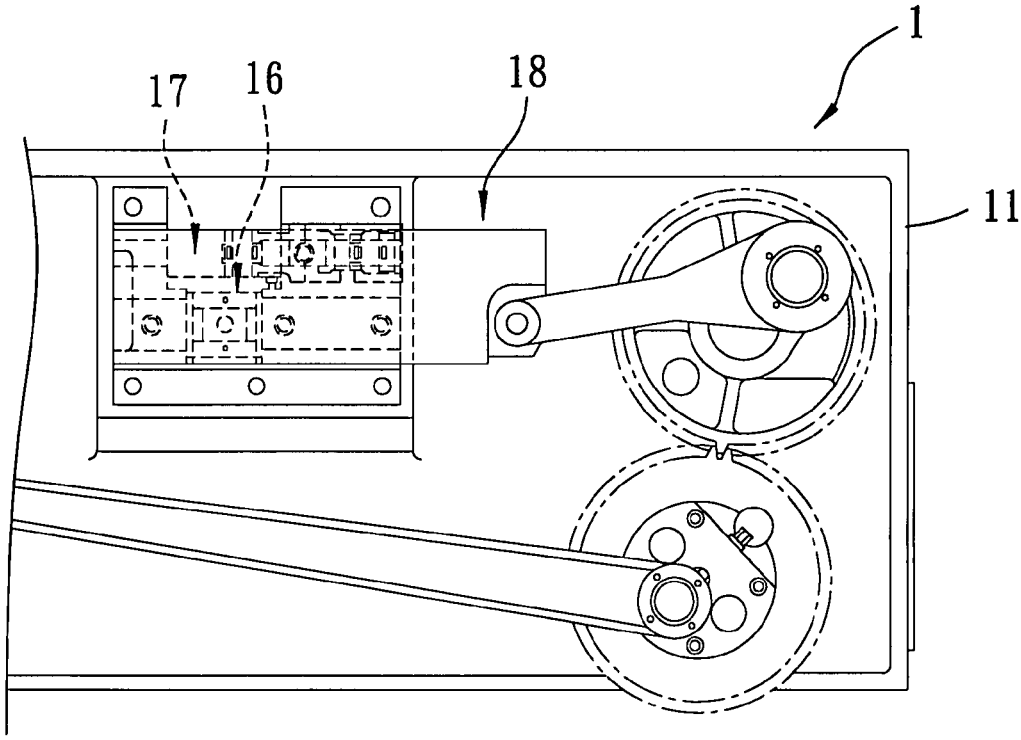
FIG. 2 PRIOR ART
FIG. 2 is a fragmentary right side view of the conventional forging machine.
Figure 3:
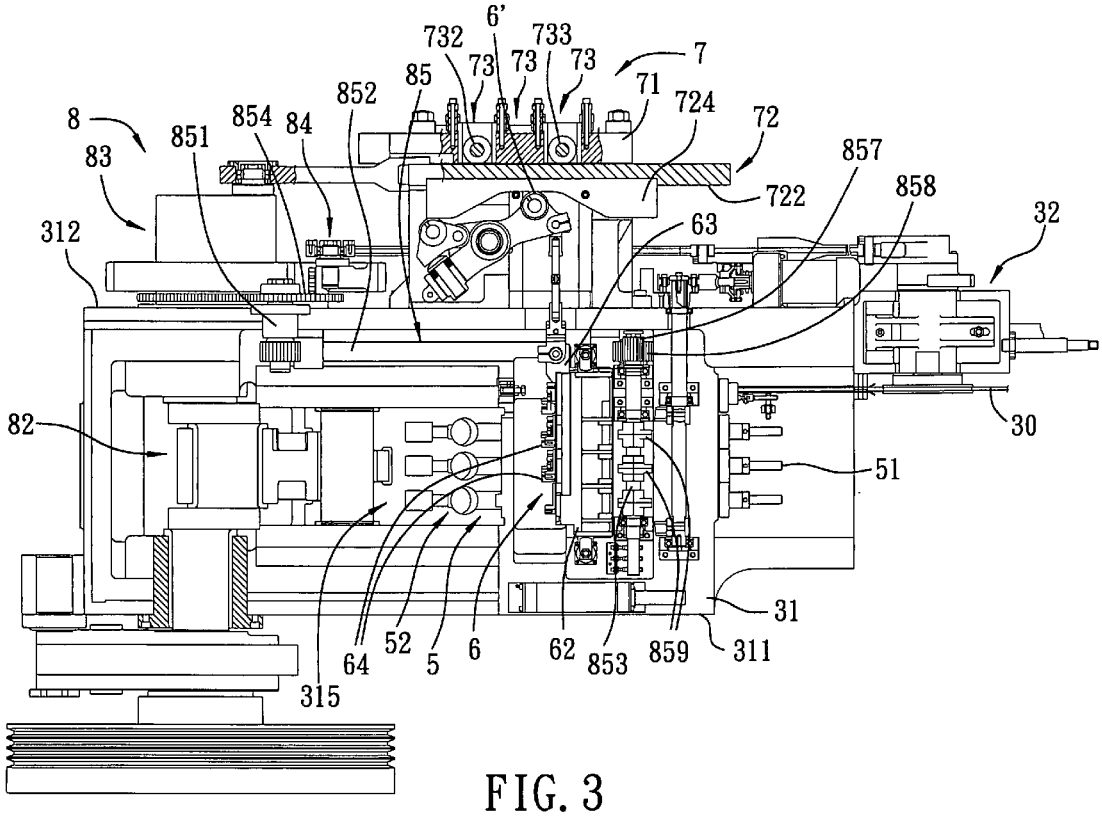
FIG. 3 is a schematic partly sectional top view of the preferred embodiment of a forging machine according to this invention.
Figure 4:
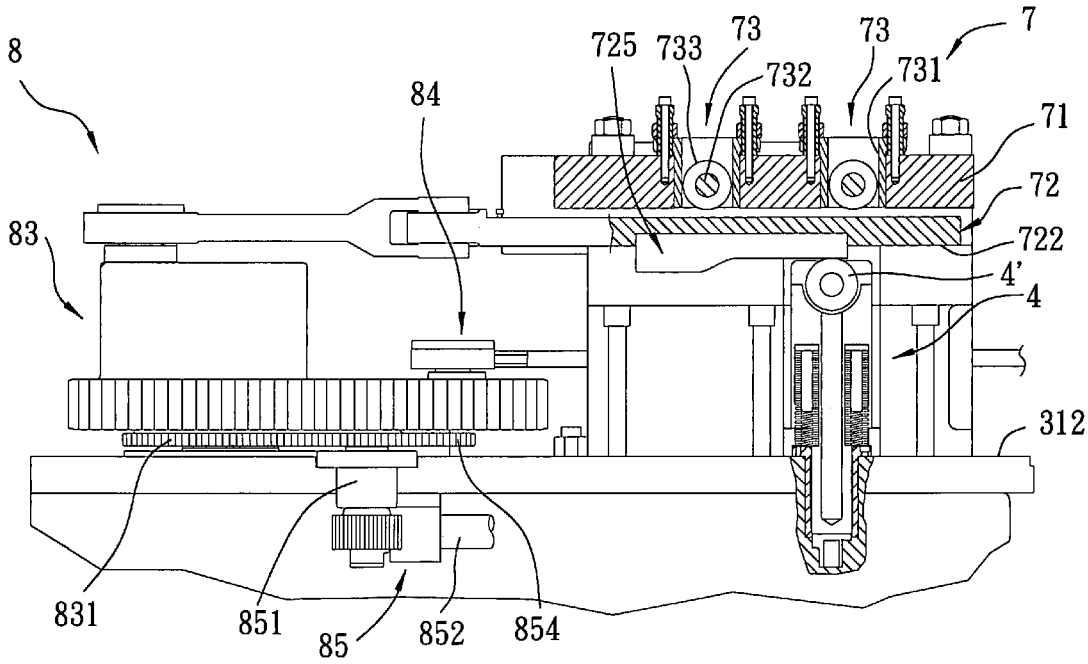
FIG. 4 is a partly sectional top view of a cutting unit of the preferred embodiment.
Figure 5:
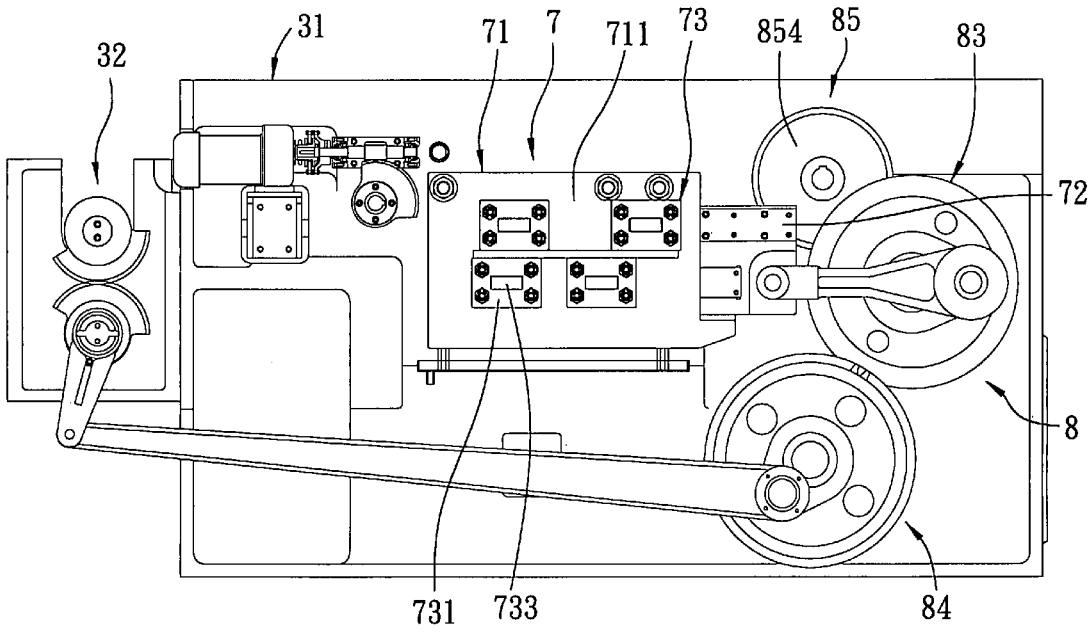
FIG. 5 is a right side view of the preferred embodiment.
Figure 6:
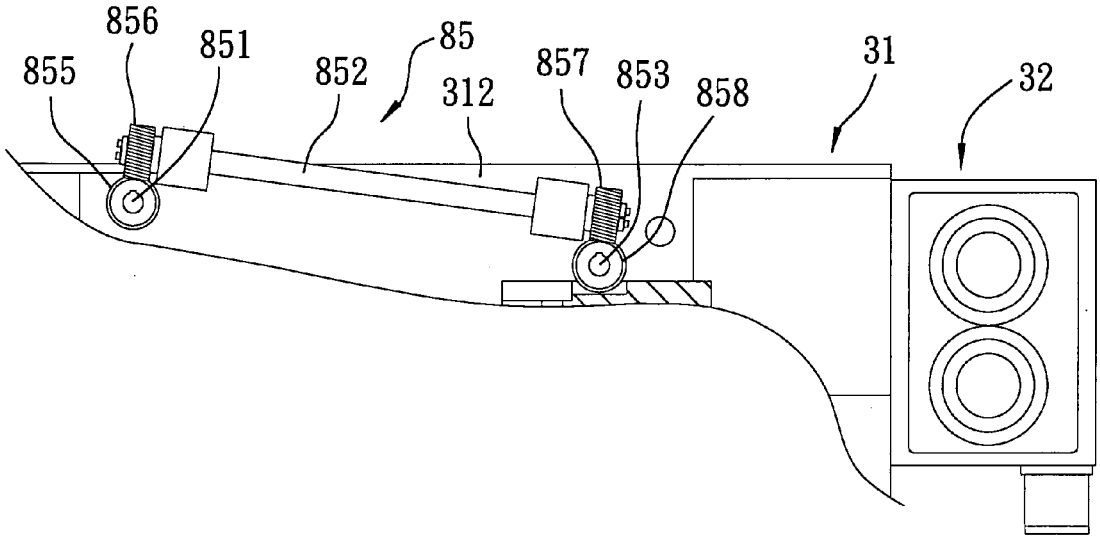
FIG. 6 is a side view of a third driving mechanism of the preferred embodiment.

Referring to FIGS. 3 and 4, the preferred embodiment of a forging machine according to this invention is shown to include a machine bed 31, a feeding unit 32, a cutting unit 4, a forging unit 5, a holding unit 6, a sliding seat unit 7, and a driving unit 8.

The machine bed 31 includes a pair of spaced-apart left and right sidewalls 311, 312 that define a forging space 315 therebetween. The feeding unit 32 is disposed at a front end of the right sidewall 312 for feeding a linear material 30 into the forging space 315.

The cutting unit 4 is disposed movably on the machine bed 31, and is movable reciprocally relative to the machine bed 31 in the forging space 315 along a direction perpendicular to the right sidewall 312 of the machine bed 31 for cutting the linear material 30 to form blanks.

The forging unit 5 is disposed within the forging space 315, and includes a female die unit 51 disposed in front of the cutting unit 4, and a male die unit 52 disposed behind the cutting unit 4 and movable reciprocally within the forging space 315 in the machine bed 31 so as to perform the forging operation.

The holding unit 6 includes a holder seat 62 disposed swingably on the machine bed 31 behind the female die unit 51, a driving plate unit 63 disposed behind the holder seat 62 and movable reciprocally along a direction perpendicular to the right sidewall 312 of the machine bed 31, and a plurality of spaced-apart holders 64 disposed between the holder seat 62 and the driving plate unit 63 and driven by the driving plate unit 63. The holders 64 can hold and convey the blanks into die cavities (not shown) in the female die unit 51. after which punch rods (not shown) of the male die unit 52 are driven to press against the blanks.

Referring to FIGS. 3, 4, 5, and 6, the driving unit 8 includes a first driving mechanism 82 disposed between the left and right sidewalls 311, 312 of the machine bed 31 for driving the forging unit 5 at an inner side of the left sidewall 311 of the machine bed 31, a driving wheel 83 disposed on an outer side surface of the right sidewall 312 of the machine bed 31 and driven by the first driving mechanism 82, a second driving mechanism 84 disposed adjacent to the right sidewall 312 of the machine bed 31 and interconnecting the driving wheel 83 and the feeding unit 31 so as to drive the feeding unit 32, and a third driving mechanism 85 disposed on the right sidewall 312 of the machine bed 31 and driven by the driving wheel 83 so as to open and close the holders 64.

The first driving mechanism 82 is configured as an eccentric shaft, is driven by a driving source (not shown) in a known manner to rotate, and has left and right ends that extend respectively through the left and right sidewalls 311, 312 of the machine bed 31. The driving wheel 83 is connected fixedly to the first driving mechanism 82 so as to allow for synchronous rotation therewith.

The third driving mechanism 85 includes first, second, and third rotating rods 851, 852, 853. The first rotating rod 851 extends perpendicular to the right sidewall 312 of the machine bed 31, and is driven by the driving wheel 83 to rotate via two gears 831, 854 (see FIG. 4) that are connected respectively and fixedly to the driving wheel 83 and the first rotating rod 851 and that mesh with each other.

The second rotating rod 852 extends parallel to the right sidewall 312 of the machine bed 31, and is driven by the first rotating rod 851 to rotate via two gears 855, 856 that are sleeved respectively and fixedly on the first and second rotating rods 851, 852 and that mesh with each other.

The third rotating rod 853 is disposed in front of and is parallel to the first rotating rod 851, and is driven by the second rotating rod 852 to rotate via two gears 857, 858 that are sleeved respectively and fixedly on the second and third driving rods 852, 853 and that mesh with each other. A plurality of spaced-apart cams 859 are sleeved fixedly on the third rotating rod 853, and are aligned respectively with the holders 64.

Referring to FIGS. 3, 4, 6, and 7, the sliding seat unit 7 is disposed at an outer side of the right sidewall 312 of the machine bed 31, and includes a work frame unit 71, a sliding plate unit 72, and a guiding roller mechanism 73.

Figure 7:
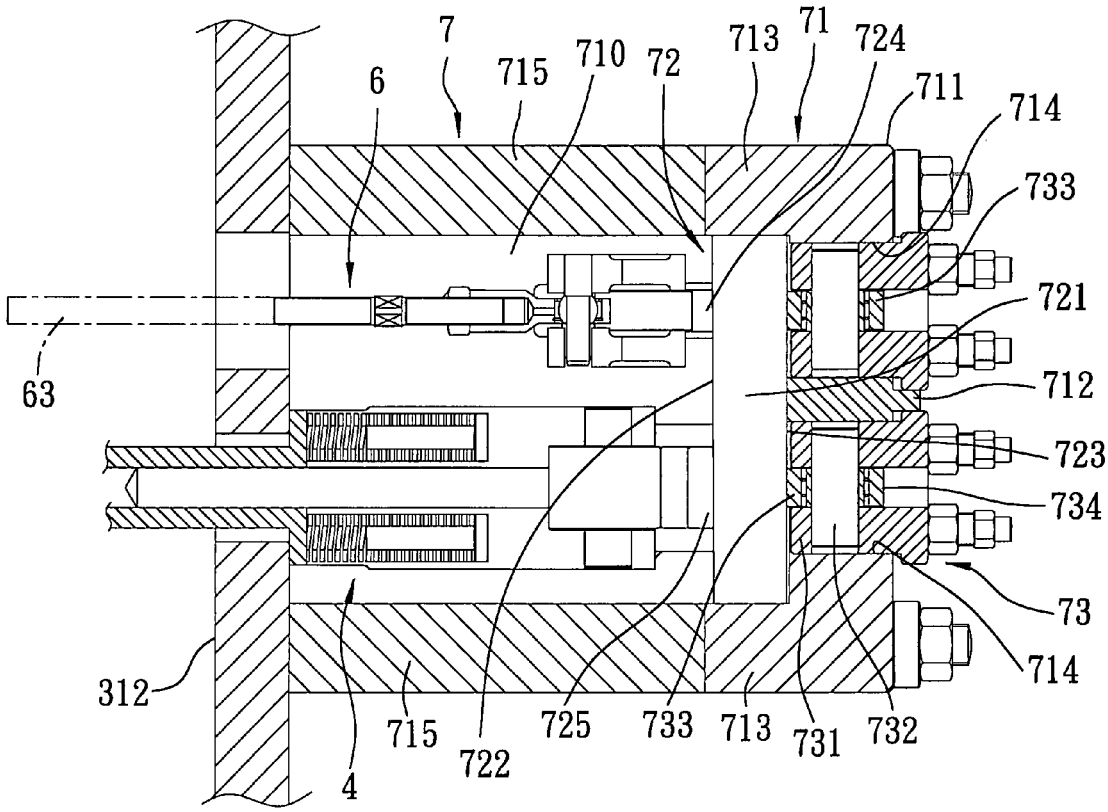
FIG. 7 is a vertical sectional view of a sliding seat unit, a holding unit, and a cutting unit of the preferred embodiment.

The work frame unit 71 includes a U-shaped supporting frame 711 having a vertical frame portion 712 and two horizontal frame portions 713 that extend respectively from upper and lower ends of the vertical frame portion 712 toward the right sidewall 312 of the machine bed 31, as shown in FIG. 7. The vertical frame portion 712 is formed with four spaced-apart grooves 714 (only two are shown in FIG. 7).

The work frame unit 71 further includes two horizontal plates 715 disposed between the right sidewall 312 of the machine bed 31 and the supporting frame 711 and connecting the horizontal frame portions 713 of the supporting frame 711 respectively and fixedly to the outer surface of the right sidewall 312 of the machine bed 31. A slide slot 710 is defined between the right sidewall 312 and the work frame unit 71, between the horizontal frame portions 713, and between the horizontal plates 715, and extends parallel to the right sidewall 312 of the machine bed 31.

The sliding plate unit 72 is driven by the driving wheel 83 to reciprocate forwardly and rearwardly within the slide slot 710, and includes a plate body 721 having an inner side surface 722 facing the right sidewall 312 of the machine bed 31, and an outer side surface 723 opposite to the inner side surface 722. The inner side surface 722 of the plate body 721 is provided with a fixed upper camming plate 724 and a fixed lower camming plate 725 that is disposed below the upper camming plate 724. The driving plate unit 63 of the holding unit 6 is provided with a rotatable follower roller 6' (see FIG. 3) biased to engage the upper camming plate 724 in a known manner. The cutting unit 4 is provided with a rotatable follower roller 4' (see FIG. 4) biased to engage the lower camping plate 725 in a known manner. Thus, the holding unit 6 and the cutting unit 4 can reciprocate leftwardly and rightwardly within the slide slot 710 in the sliding seat unit 7.

The guiding roller mechanisms 73 are disposed on the work frame unit 71. Each of the guiding roller mechanisms 73 includes a base 731 fixed within the corresponding groove 714 in the work frame unit 71, a vertical central shaft 732 fixed on the base 731, and a guiding roller 733 sleeved rotatably on the central shaft 732. Each of the guiding rollers 733 is configured as a ball roller, and has an outer race 734 abutting against the outer side surface of the plate body 721 of the sliding plate unit 72.

Referring to FIGS. 3, 4, 5, 6, and 7, in operation, the first driving mechanism 82 is driven by the driving source (not shown) to rotate. Rotation of the first driving mechanism 82 is transferred to the driving wheel 83. The driving wheel 83 drives the feeding unit 32 via the second driving mechanism 84 in a known manner. Rotation of the driving wheel 83 is transferred to the third rotating rod 853 through the first and second rotating rods 851, 852 so that the cams 859 drive the holders 64 to open and close. When the driving wheel 83 rotates, it drives the plate body 721 of the sliding plate unit 72 to reciprocate forwardly and rearwardly so as to drive the cutting unit 4 and the driving plate unit 63 of the holding unit 6 to reciprocate leftwardly and rightwardly.

Because the structures of the feeding unit 32, the female die unit 51, the male die unit 52, the cutting unit 4, the holding unit 6, and the driving unit 8 are known in the art and are not pertinent to the claimed invention, a detailed description thereof will be omitted herein for the sake of brevity.

The forging machine of this invention has the following advantages:

(1) When the cutting unit 4 and the driving plate unit 63 of the holding unit 6 reciprocate relative to the sliding plate unit 72 so that a rightward impacting force is applied to the sliding plate unit 72, the guiding roller mechanisms 73 can prevent the sliding plate unit 72 from undergoing rightward movement. Therefore, the sliding plate unit 72 can move smoothly on the machine bed 31.

(2) By disposing the driving unit 8 at the inner side of the left sidewall 311 of the machine bed 31, no driving rods are provided at the outer side of the left sidewall 311 of the machine bed 31. Therefore, a technician can stand adjacent to the outer side surface of the left sidewall 311 at a location adjacent to the holding unit 6 so as to check the condition of the holding unit 6. The holder seat 62 of the holding unit 6 can be turned upwardly relative to the machine bed 31 so as to allow for inspection and/or repair by the technician.

With this invention thus explained, it is apparent that numerous modifications and variations can be made without departing from the scope and spirit of this invention. It is therefore intended that this invention be limited only as indicated by the appended claims.

I claim:

1. A forging machine comprising:

a machine bed including a pair of spaced-apart left and right sidewalls that define a forging space therebetween and that have front and rear ends;

a feeding unit disposed at a front end of said right sidewall and adapted to feed a linear material into said forging space;

a cutting unit disposed movably on said machine bed and movable reciprocally relative to said machine bed within said forging space along a direction perpendicular to said right sidewall of said machine bed;

a forging unit disposed within said forging space in said machine bed and including a female die unit disposed in front of said cutting unit, and a male die unit disposed behind said cutting unit and movable reciprocally within said forging space in said machine bed so as to perform a forging operation;

a holding unit including a holder seat disposed swingably on said machine bed behind said female die unit, a driving plate unit disposed behind said holder seat and movable reciprocally along a direction perpendicular to said right sidewall of said machine bed, and a plurality of spaced-apart holders disposed behind said holder seat and driven by said driving plate unit;

a driving unit including a first driving mechanism disposed between said left and right sidewalls of said machine bed for driving said forging unit, a driving wheel disposed on an outer side surface of said right sidewall of said machine bed and driven by said first driving mechanism, a second driving mechanism disposed adjacent to said right sidewall of said machine bed and interconnecting said driving wheel and said feeding unit so as to drive said feeding unit, and a third driving mechanism disposed on said right sidewall of said machine bed and driven by said driving wheel so as to open and close said holders, said third driving mechanism including a first rotating rod extending perpendicular to said right sidewall of said machine bed and driven by said driving wheel to rotate, a second rotating rod extending parallel to said right sidewall of said machine bed and driven by said first rotating rod to rotate, a third rotating rod disposed in front of and parallel to said first rotating rod and driven by said second rotating rod to rotate, and a plurality of spaced-apart cams sleeved fixedly on said third rotating rod and aligned respectively with said holders; and a sliding seat unit including a work frame unit disposed fixedly on said outer side surface of said right sidewall of said machine bed and defining a slide slot that is disposed between said work frame unit and said right sidewall and that extends parallel to said right sidewall, a sliding plate unit driven by said driving wheel to reciprocate forwardly and rearwardly within said slide slot, said sliding plate unit including a plate body having an inner side surface facing said right sidewall of said machine bed, and an outer side surface opposite to said inner side surface of said plate body of said sliding plate unit, said inner side surface of said plate body of said sliding plate unit being connected to said driving plate unit of said holding unit and said cutting unit such that said driving plate unit of said holding unit and said cutting unit can reciprocate leftwardly and rightwardly within the slide slot in said sliding seat unit when said sliding plate unit reciprocates forwardly and rearwardly within said slide slot, and two guiding roller mechanisms disposed on said work frame unit and arranged one above another, each of said guiding roller mechanisms including a base fixed on said work frame unit, a vertical central shaft fixed on said base, and a guiding roller sleeved rotatably on said central shaft, each of said guiding rollers being configured as a ball roller and having an outer race abutting against said outer side surface of said plate body of said sliding plate unit.

2. The forging machine as claimed in claim 1, wherein said work frame unit of said sliding seat unit includes:

a U-shaped supporting frame having a vertical frame portion and two horizontal frame portions that extend respectively from upper and lower ends of said vertical frame portion toward said right sidewall of said machine bed; and two horizontal plates disposed between said right sidewall of said machine bed and said supporting frame and connecting said horizontal frame portions of said supporting frame respectively and fixedly to said right sidewall, said sliding slot being located between said horizontal plates.

3. The forging machine as claimed in claim 2, wherein said vertical frame portion of said supporting frame is formed with two spaced-apart grooves that are arranged one above another, said bases of said guiding roller mechanisms being disposed respectively and fixedly within said grooves in said vertical frame portion of said supporting frame.

* * * * *